US010493482B2

(12) United States Patent
Su

(10) Patent No.: US 10,493,482 B2
(45) Date of Patent: Dec. 3, 2019

(54) ANGLE ADJUSTABLE PISTOL-TYPE WATERING NOZZLE

(71) Applicant: Ho Chin Chen, Taichung (TW)

(72) Inventor: Shian Chun Su, Yunlin County (TW)

(73) Assignee: Ho Chin Chen, Taichung (TW)

( * ) Notice: Subject to any disclaimer, the term of this patent is extended or adjusted under 35 U.S.C. 154(b) by 135 days.

(21) Appl. No.: 15/412,285

(22) Filed: Jan. 23, 2017

(65) Prior Publication Data

US 2018/0161795 A1 Jun. 14, 2018

(30) Foreign Application Priority Data

Dec. 8, 2016 (TW) ..... 105218713 U

(51) Int. Cl.
*B05B 15/652* (2018.01)
*B05B 1/30* (2006.01)

(52) U.S. Cl.
CPC ..... *B05B 15/652* (2018.02); *B05B 1/30* (2013.01)

(58) Field of Classification Search
CPC ..... B05B 1/12; B05B 1/3046; B05B 12/002; B05B 15/62; B05B 1/3013; B05B 1/3033; B05B 15/061; B05B 9/01; B05B 15/652; B05B 15/066; B05B 1/16; B05B 1/30; B05B 1/3026; B05B 1/1654; B05B 1/18
See application file for complete search history.

(56) References Cited

U.S. PATENT DOCUMENTS 2,307,014 A * 1/1943 Becker ..... B05B 1/12 239/438
2,457,526 A * 12/1948 Brown ..... B05B 1/12 137/614.11
6,007,001 A * 12/1999 Hilton ..... A62C 31/03 239/452
6,042,029 A * 3/2000 Massey ..... A62C 31/05 239/587.1
6,073,863 A * 6/2000 Wang ..... B05B 1/3026 239/525
6,367,716 B1 * 4/2002 Wang ..... B05B 1/3026 239/525
6,540,163 B1 * 4/2003 Huang ..... B05B 15/652 239/587.5
7,124,965 B1 * 10/2006 Chen ..... A62C 31/02 239/525
7,140,561 B2 * 11/2006 Heren ..... B05B 15/652 239/525
7,195,181 B2 * 3/2007 Steingass ..... B05B 1/304 169/14
7,240,858 B2 * 7/2007 Wang ..... B05B 1/3013 239/395

(Continued)

*Primary Examiner* — Arthur O. Hall
*Assistant Examiner* — Steven M Cernoch
(74) *Attorney, Agent, or Firm* — Bacon & Thomas, PLLC

(57) ABSTRACT

An angle adjustable pistol-type watering nozzle includes a handle, a nozzle head, a control member and a valve. The nozzle head is pivotable relative to the handle by two respective pivotal portions of the nozzle head and the handle. The valve is located in the pivotal portions and is driven by the control member to align the inlet or the seal member of the valve with the passage of the handle to control the watering feature of the watering nozzle. The watering nozzle is functioned normally to eject water from the nozzle head at any angle that the nozzle head is pivoted relative to the handle.

5 Claims, 10 Drawing Sheets

(56) References Cited

U.S. PATENT DOCUMENTS

| | | | | |
|---|---|---|---|---|
| 7,328,860 | B1 * | 2/2008 | Chen | B05B 1/3026 137/625.31 |
| 7,429,029 | B2 * | 9/2008 | Wang | F16K 5/0478 239/526 |
| 7,533,833 | B2 * | 5/2009 | Wang | B05B 1/1681 239/443 |
| 8,087,597 | B2 * | 1/2012 | Cheng | B05B 1/12 239/525 |
| 8,123,151 | B2 * | 2/2012 | Cheng | B05B 1/3026 239/525 |
| 8,381,769 | B2 * | 2/2013 | Hsieh | B05B 1/3013 137/614.19 |
| 8,490,948 | B2 * | 7/2013 | Lu | A01G 25/00 239/526 |
| 8,596,558 | B2 * | 12/2013 | Lai | B05B 1/3026 239/525 |
| 9,707,573 | B1 * | 7/2017 | Huang | B05B 1/12 |
| 9,770,731 | B1 * | 9/2017 | Chen | B05B 1/326 |
| 9,861,992 | B1 * | 1/2018 | Chen | B05B 1/3026 |
| 9,901,948 | B1 * | 2/2018 | Chen | B05B 12/002 |
| 2006/0249599 | A1 * | 11/2006 | Guo | B05B 1/3013 239/530 |
| 2014/0054399 | A1 * | 2/2014 | Hsieh | B05B 1/3026 239/526 |

* cited by examiner

ANGLE ADJUSTABLE PISTOL-TYPE WATERING NOZZLE

BACKGROUND OF THE INVENTION

1. Fields of the Invention

The present invention relates to a watering nozzle, and more particularly, to an angle adjustable pistol-type watering nozzle with a control member to control operation at any angle.

2. Descriptions of Related Art

The conventional watering nozzle known to applicant is disclosed in U.S. Pat. No. 6,367,716 and comprises a pistol nozzle having a main body with a water conduit extending therethrough. The water conduit has a water outlet in communication therewith. The pistol nozzle has a nozzle head through which the water outlet extends. The pistol nozzle has a sleeve positioned between the main body and the nozzle head. The sleeve has a washer. An adjusting member of a U-shaped construction has two arms. Each of the two arms having fitting hole formed therein. Two locating members each have a locating block. A shaft has a generally spherical portion formed centrally therealong. The spherical portion has a water emission hole. The shaft has retaining grooves formed adjacent respective opposite ends thereof. The shaft has protrusions extending outwardly from respective opposite ends of said shaft. Each of said protrusions has a retaining hole formed therein. Two washers are respectively retained in the retaining grooves of the shaft. The shaft is disposed in the water outlet. The spherical portion of the shaft is in intimate contact with the washer of said sleeve. The protrusions of the shaft are retained respectively within the fitting holes of the adjusting member. The adjusting member and the shaft is retained by the two locating members such that the locating blocks are retained respectively in the retaining holes of the protrusions of the shaft. The shaft is rotatable by the adjusting member so as to align the water emission hole of the shaft with the sleeve.

Another conventional watering nozzle known to applicant is disclosed in U.S. Pat. No. 6,540,159 and comprises a handle and a spray nozzle head fastened adjustably to a top end of the handle. The top end of the hand is provided with a first fastening seat, whereas the spray nozzle head is provided at an inner end with a second fastening seat. The first fastening seat is provided with a tubular projection and a locating pin. The second fastening seat is provided with a fastening hole and a plurality of locating slots corresponding in location to the locating pin. The first fastening seat is rotatably fastened to the second fastening seat such that the tubular projection of the first fastening seat is rotatably retained in the fastening hole of the second fastening seat, and that the locating pin of the first fastening seat is removably retained in one of the locating slots of the second fastening seat.

Although the first conventional nozzle has an individual control mechanism for controlling the water to be ejected from the nozzle, however, the handle and the nozzle are formed as an one piece so that the users cannot adjust the angle of the nozzle relative to the handle. The second conventional nozzle includes an individual for controlling the angle of the nozzle relative to the handle. Nevertheless, the nozzle cannot be operated when the angle of the nozzle is adjusted.

The present invention intends to provide a watering nozzle wherein nozzle is operated at any angle.

SUMMARY OF THE INVENTION

The present invention relates to a watering nozzle and comprises a handle having a passage defined therethrough.

A first pivotal portion 12 formed on an end of the handle and has a pivotal end. A nozzle head has a water way defined therein. A second pivotal portion is formed on one end of the water way and pivotably connected to the first pivotal portion. A control member 30 is a U-shaped member, and two side plates are connected to two ends of the control member. The two plates are respectively and pivotably connected to the handle and the second pivotal portion of the nozzle head. Each plate has a hole defined therethrough, and each hole has a positioning slot defined in the inner periphery thereof. A bridge member is connected between the two plates. A valve is a cylindrical valve and inserted into the first pivotal portion and the pivotal end of the handle, and a through hole defined through the second pivotal portion of the nozzle head. The valve has a path defined therein which has the first end thereof which is a closed end. Two end plates are respectively connected to two end of the path. The valve has an inlet and a seal member. The inlet and the seal member are located corresponding to the passage of the handle. The valve has an outlet and a groove. The outlet and the groove are located corresponding to the water way of the nozzle head. The valve has a boss protruding from one end thereof. A tongue extends from the closed end of the path. The valve is rotated when the control member is pivoted so as to open the passage when the inlet communicates with the passage, or to close the passage when the seal member seals the passage. When the inlet communicates with the passage, water passes through the path and flows to the groove via the outlet, and flows through the entrance and the water way of the nozzle head.

Preferably, the pivotal end includes an entrance. Two seal rings are located on two ends of the entrance.

Preferably, the second pivotal portion has a through hole with which the first pivotal portion is rotatably connected.

Preferably, the second pivotal portion of the nozzle head has a protrusion extending axially therefrom. The first pivotal portion of the handle has a first recess in which the protrusion is movable received so as to restrict rotational angle of the nozzle head.

Preferably, the valve includes a second recess defined therein and the second recess is located beside the inlet. The first pivotal portion of the handle has a positioning block protruding inward from the inner periphery thereof. The positioning block is movably received in the second recess when the valve is located in the first pivotal portion to restrict rotational angle of the nozzle head relative to the handle.

Preferably, a seal ring is located between the valve and the first pivotal portion. Another seal ring is located between the pivotal end and the second pivotal portion.

Preferably, a second end of the path is an open end and an end plate seals the second end of the path. Another end plate has a notch defined in the inside thereof. The tongue of the valve is engaged with the notch. The end plates seal two ends of the valve.

The primary object of the present invention is to provide a watering nozzle wherein the nozzle head is pivotable relative to the handle so adjust the angle of the nozzle head when in use. Water is ejected from the nozzle head by pivoting the control member while the nozzle head is adjusted an angle relative to the handle.

The present invention includes the following features:

The first pivotal portion of the handle is pivotably connected to the second pivotal portion of the nozzle head so that the angle of the nozzle is adjustable relative to the handle.

The valve is inserted into the pivotal end of the first pivotal portion of the handle and the through hole of the second pivotal portion of the nozzle head, the valve is controlled by the control member so that the nozzle head is normally functioned when the nozzle head is set at an angle relative to the handle.

The second pivotal portion of the nozzle head has protrusion which is movably inserted into the first recess so that the angle that the nozzle head is rotated relative to the handle is restricted.

The valve includes a second recess that is located beside the inlet. The handle has a positioning block in the first pivotal portion. When the valve is installed to the first pivotal portion of the handle, the positioning block is located corresponding to the second recess so as to position the control member. When pivoting the control member, the valve is co-rotated and the positioning block is moved in the second recess so that the angle that the nozzle head is rotatable is restricted.

The present invention will become more apparent from the following description when taken in connection with the accompanying drawings which show, for purposes of illustration only, a preferred in accordance with the present invention.

DETAILED DESCRIPTION OF THE PREFERRED EMBODIMENT

Figure 1:
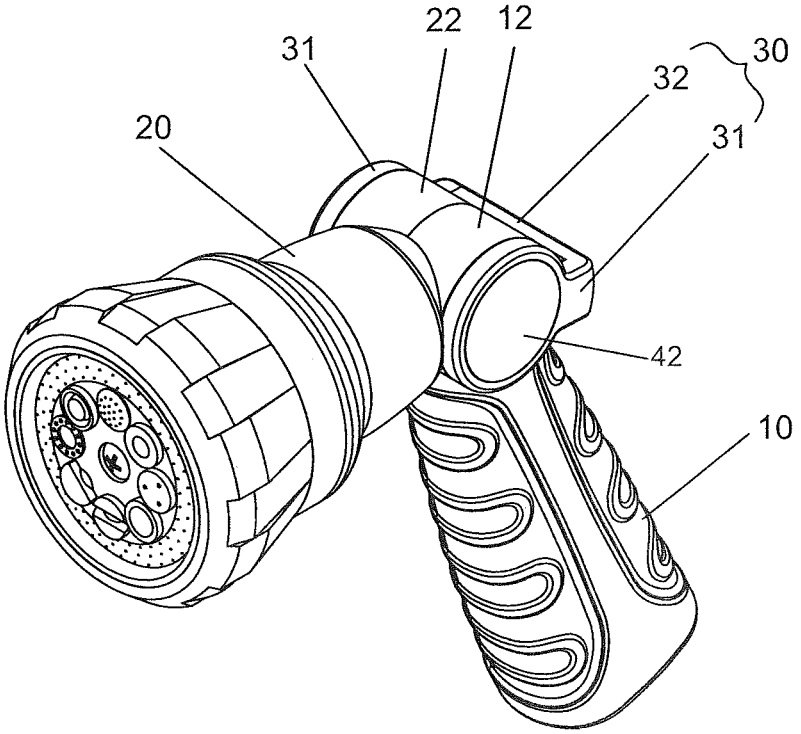
FIG. 1 is a perspective view to show the watering nozzle of the present invention.

Referring to FIGS. 1 to 10, the watering nozzle of the present invention comprises a handle 10, a nozzle head 20, a control member 30 and a valve 40.

The handle 10 has a passage 11 defined therethrough. A first pivotal portion 12 is formed on one end of the handle 10, and the first pivotal portion 12 has a pivotal end 13. The pivotal end 13 includes an entrance 14, and two seal rings 15 are located on two ends of the entrance 14.

The nozzle head 20 has a water way 21 defined therein. A second pivotal portion 22 is formed on one end of the water way 21 and pivotably connected to the first pivotal portion 12. The second pivotal portion 22 has a through hole 23 with which the pivotal end 13 of the first pivotal portion 12 is rotatably connected. The nozzle head 20 is pivoted relative to the handle 10 by the first and second pivotal portions 12, 22.

The control member 30 is a U-shaped member, and two side plates 31 are connected to two ends of the control member 30. The two plates 31 are respectively and pivotably connected to the first pivotal portion 12 of the handle 10 and the second pivotal portion 22 of the nozzle head 20. Each plate 31 has a hole 311 defined therethrough. Each hole 311 has a positioning slot 312 defined in the inner periphery thereof. A bridge member 32 is connected between the two plates 31.

The valve 40 is a cylindrical valve and inserted into the first pivotal portion 12 and the pivotal end 13 of the handle 10, and a through hole 23 is defined through the second pivotal portion 22 of the nozzle head 20. The valve 40 has a path 41 defined therein which has a first end which is a closed end. Two end plates 42 are respectively connected to two end of the path 41. The valve 40 has an inlet 411 and a seal member 412. The inlet 411 and the seal member 412 are located corresponding to the passage 11 of the handle 10. The valve 40 has an outlet 413 and a groove 414, and the outlet 413 and the groove 414 are located corresponding to the water way 21 of the nozzle head 20. A seal ring 43 is located between the valve 40 and the first pivotal portion 12, and another seal ring 43 is located between the pivotal end 13 and the second pivotal portion 22. The valve 40 has a boss 44 protruding from one end thereof. A tongue 45 extends from the closed end of the path 41.

The nozzle head 20 is pivoted relative to the handle 10 by the first and second pivotal portions 12, 22. The valve 40 is rotated when the control member 30 is pivoted so as to open the passage 11 when the inlet 411 communicates with the passage 11, or to close the passage 11 when the seal member 412 seals the passage 11. When the inlet 411 communicates with the passage 11, water passes through the path 41 and flows to the groove 414 via the outlet 413, and hen flows through the entrance 14 and the water way 21 of the nozzle head 20.

As shown in FIGS. 1 to 4 and 9, the nozzle head 20 is pivoted relative to the handle 10 by the first and second pivotal portions 12, 22 so that the users can set the angular positions of the nozzle head 20 according to practical needs. The second pivotal portion 22 of the nozzle head 20 has a protrusion 24 extending axially therefrom. The first pivotal portion 12 of the handle 10 has a first recess 16 in which the protrusion 24 is movable received so as to restrict rotational angle of the nozzle head 20.

Figure 2:
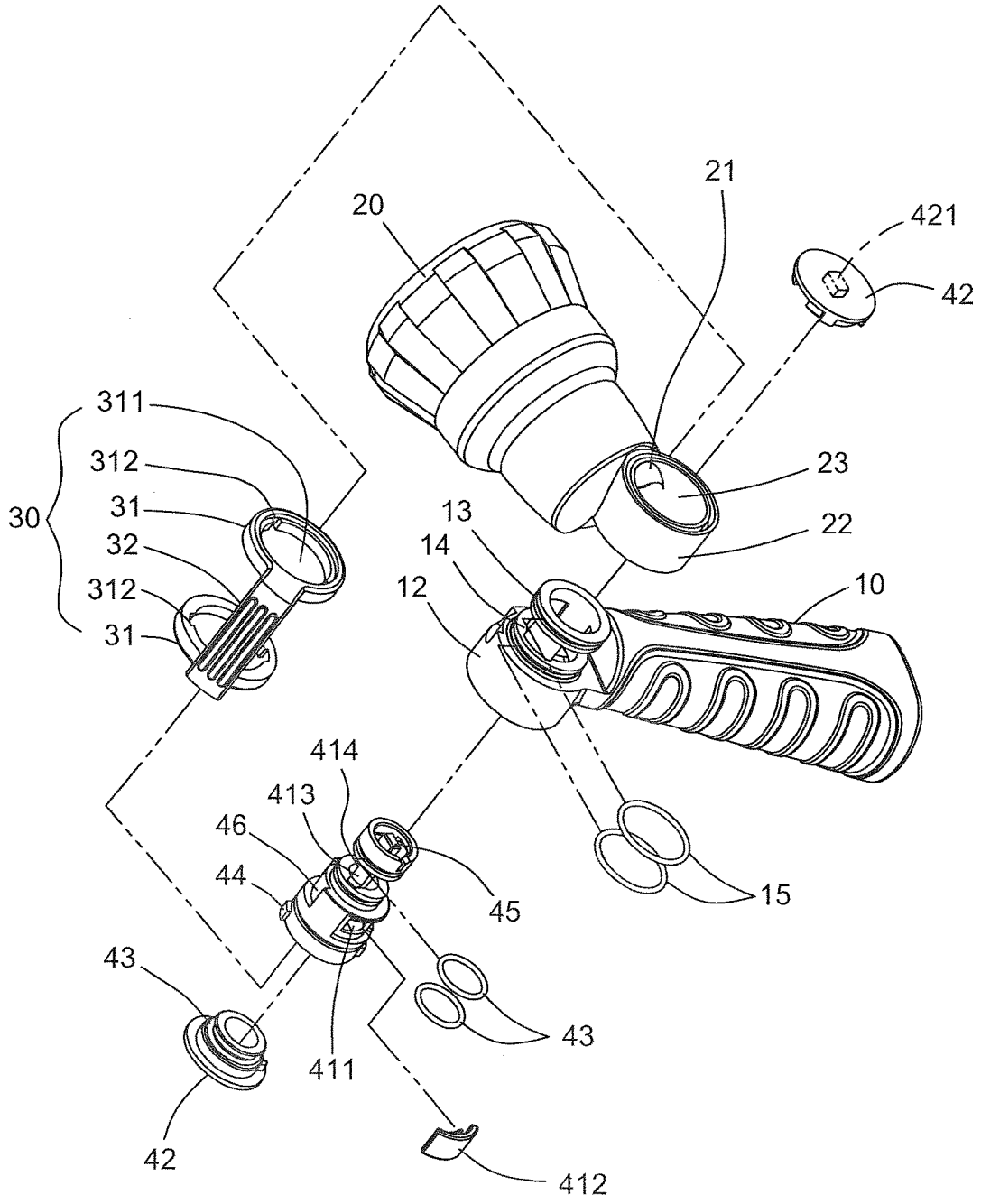
FIG. 2 is an exploded view of the watering nozzle of the present invention.
Figure 3:
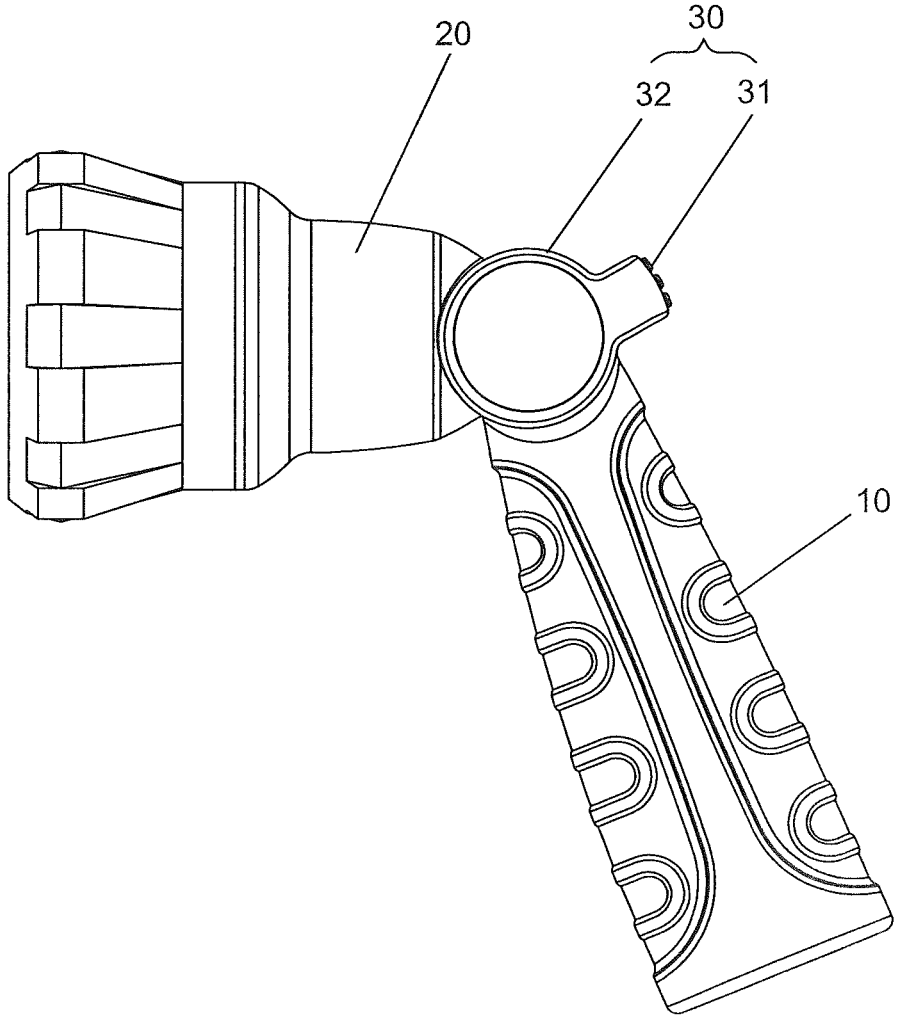
FIGS. 3 and 4 show the angle change of the nozzle head relative to the handle.
Figure 4:
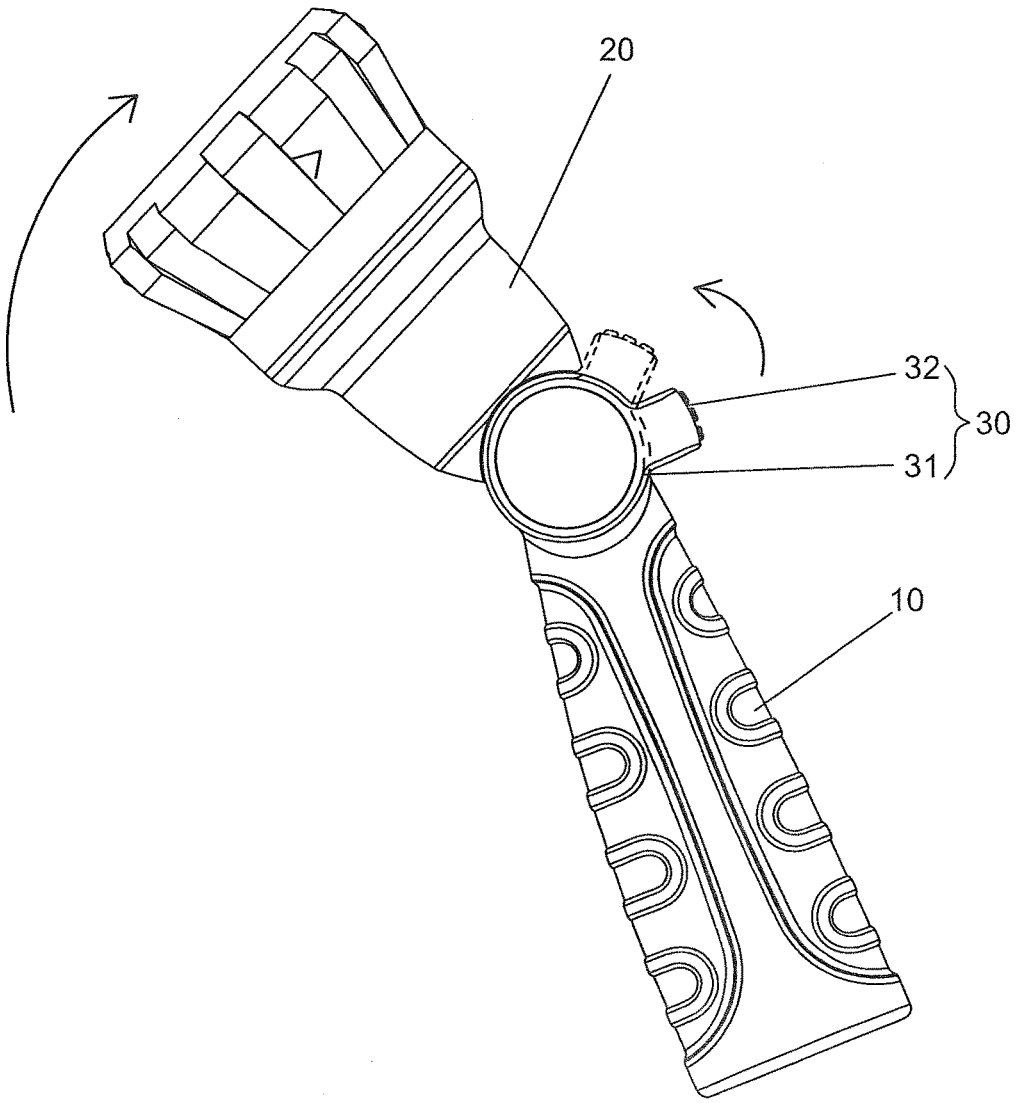
Figure 5:
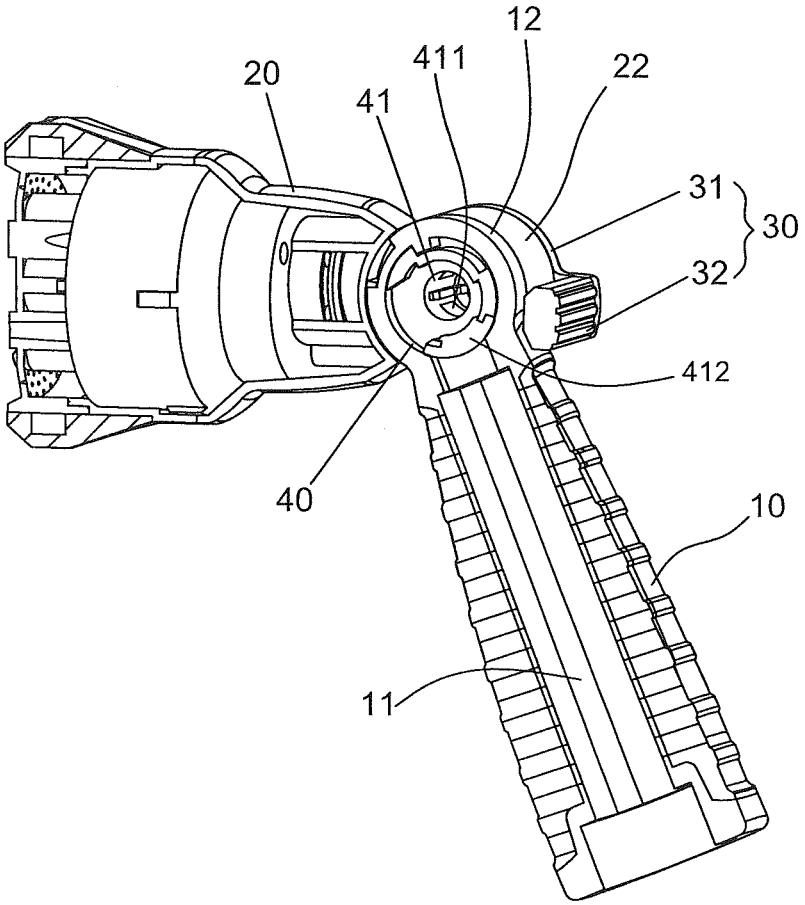
FIGS. 5 and 6 show that the valve is rotated to stop the water from entering into the nozzle head.
Figure 6:
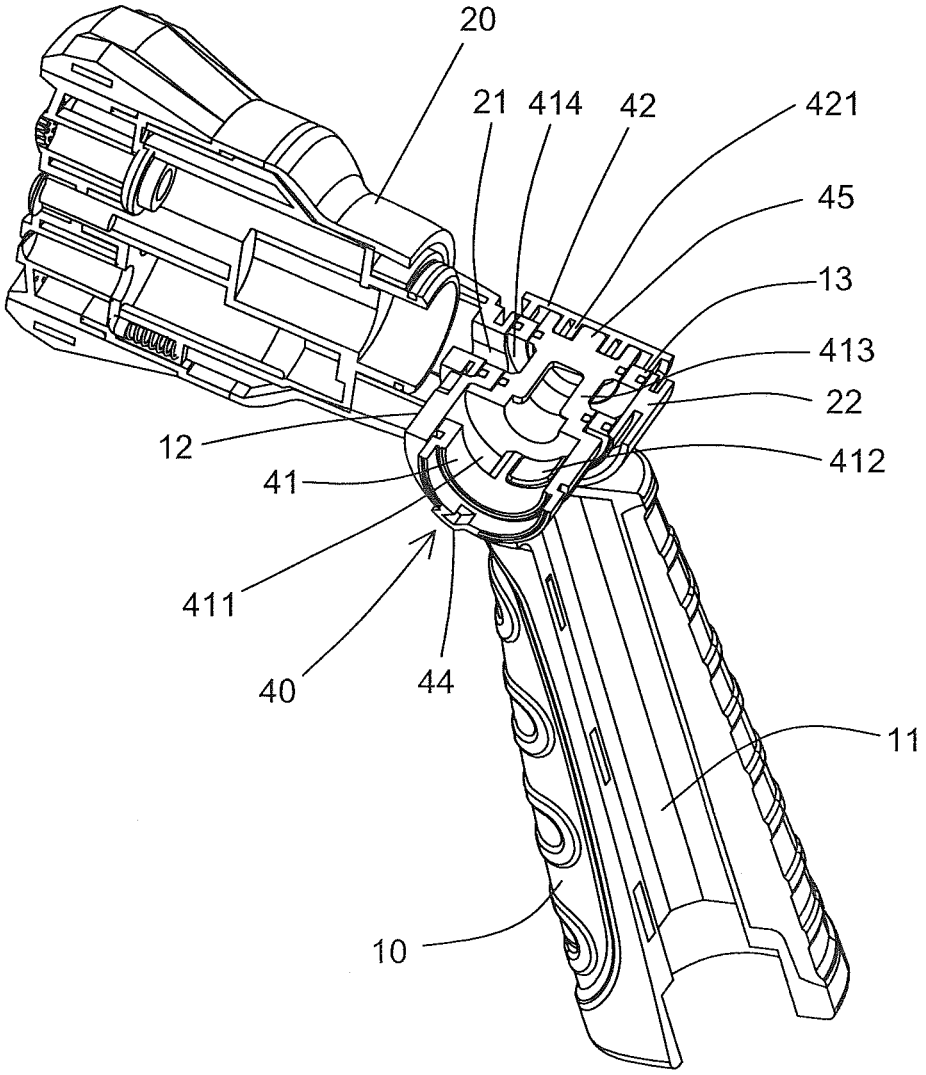

As shown in FIGS. 2, 5 and 6, the valve 40 is rotated within the first and second pivotal portions 12, 22 when the control member 30 is pivoted so as to control the watering function of the nozzle head 20. As shown in FIGS. 5 and 6, the bridge member 32 of the control member 30 is pivoted toward the handle 10, the boss 44 of the valve 40 in the positioning slot 312 is moved to rotate the valve 40 clockwise so that the seal member 412 is moved to seal the passage 11 of the handle 10 to that the water cannot pass through the valve 40.

Figure 7:
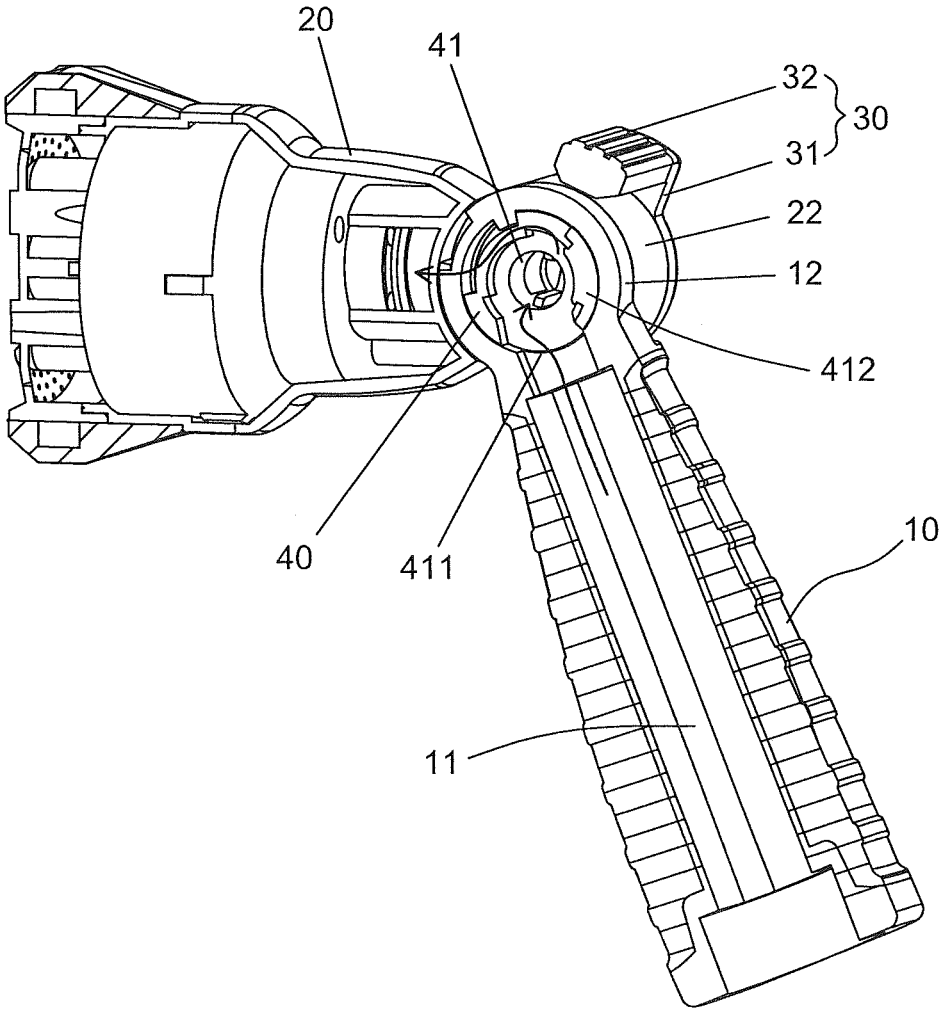
FIGS. 7 and 8 show that the valve is rotated to open path such that water enters into the nozzle head.
Figure 8:
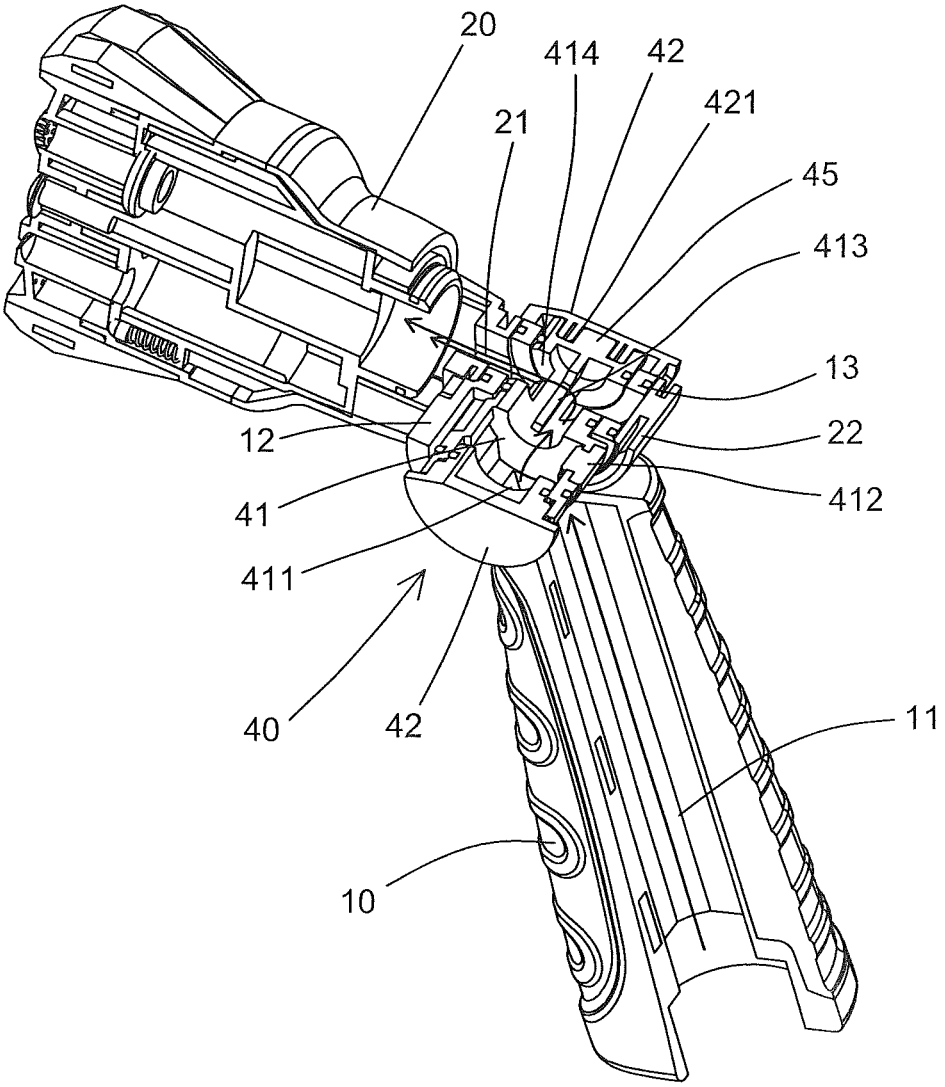
Figure 9:
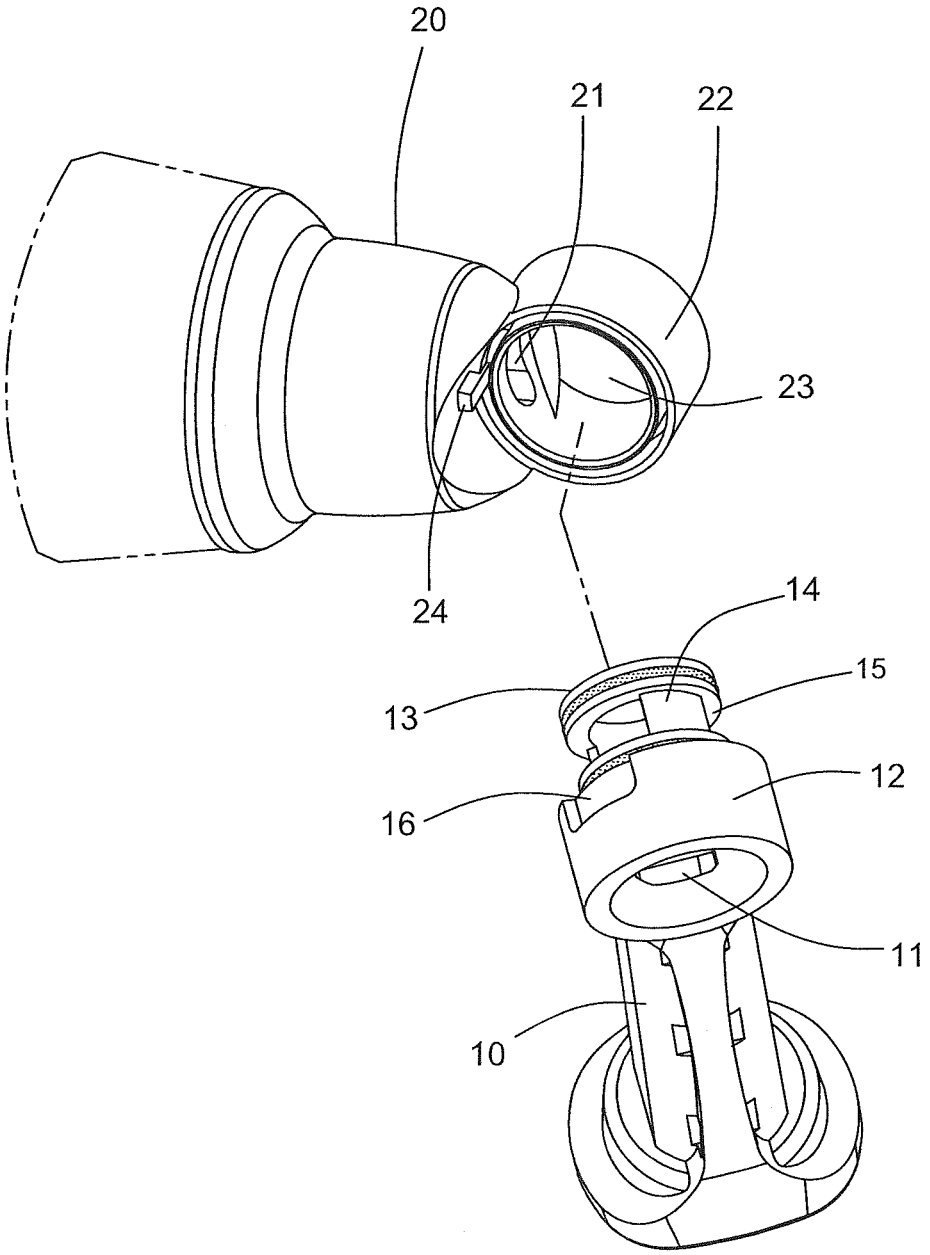
FIG. 9 shows the first pivotal portion of the handle and the second pivotal portion of the nozzle head.
Figure 10:
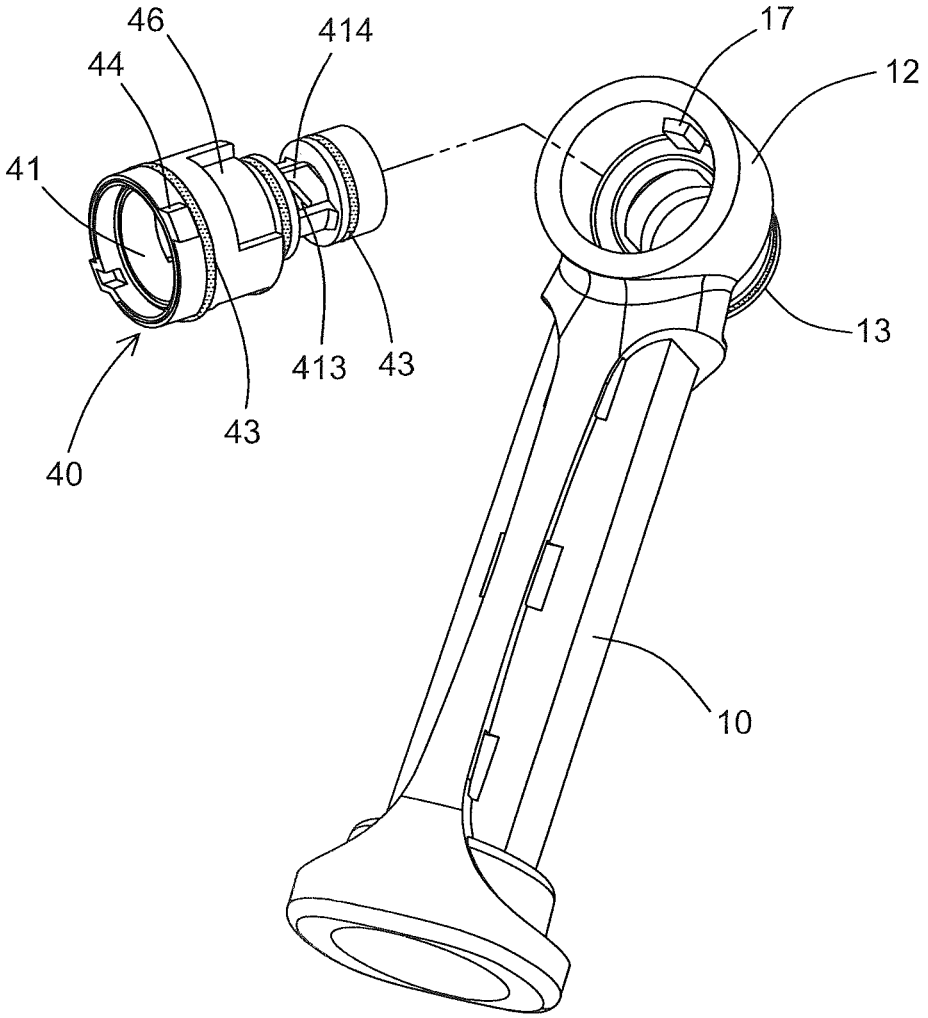
FIG. 10 shows the valve and the handle of the watering nozzle of the present invention.

As shown in FIGS. 7 and 8, when the control member 30 is pivoted toward the nozzle head 20, and the valve 40 is rotated counter clockwise and the inlet 411 of the first pivotal portion 12 of the handle 10 is located corresponding to the passage 11. Therefore, water is able to enter into the path 41 of the valve 40 and then flows to the groove 414 via the outlet 413. The water then flows to the water way 21 of the nozzle head 20 via the entrance 14 and the groove 414. The water then flows out from the nozzle head 20. In other words, the nozzle head 20 is functioned normally. As shown in FIG. 10, the valve 40 includes a second recess 46 defined therein and the second recess 46 is located beside the inlet 411. The first pivotal portion 12 of the handle 10 has a positioning block 17 protruding inward from the inner periphery thereof. The positioning block 17 is movably received in the second recess 46 when the valve 40 is located in the first pivotal portion 12 to restrict rotational angle of the nozzle head 20 relative to the handle 10.

As shown in FIGS. 2, 6 and 8, the second end of the path 41 is an open end and an end plate 42 seals the second end of the path 41. Another end plate 42 has a notch 421 defined in the inside thereof. The tongue 45 of the valve 40 is engaged with the notch 421. The end plates 42 seal two ends of the valve 40, so that the operation of the valve 40 and the control member 30 is stable and does not leak.

While we have shown and described the embodiment in accordance with the present invention, it should be clear to those skilled in the art that further embodiments may be made without departing from the scope of the present invention.

What is claimed is:

1. A watering nozzle comprising:

a handle having a passage defined therethrough, a first pivotal portion formed on an end of the handle, the first pivotal portion having a pivotal end, the pivotal end including an entrance, two seal rings located on two ends of the entrance;

a nozzle head having a water way defined therein, a second pivotal portion formed on an end of the water way and pivotably connected to the first pivotal portion;

a control member being a U-shaped member, two side plates connected to two ends of the control member, the two plates respectively and pivotably connected to the handle and the second pivotal portion of the nozzle head, each plate having a hole defined therethrough, each hole having a positioning slot defined in an inner periphery thereof, a bridge member connected between the two plates;

a valve being a cylindrical valve and inserted into the first pivotal portion and the pivotal end of the handle, and a through hole defined through the second pivotal portion of the nozzle head, the valve having a path defined therein which has a first end which is a closed end, two end plates respectively connected to two end of the path, the valve having an inlet and a seal member, the inlet and the seal member located corresponding to the passage of the handle, the valve having an outlet and a groove, the outlet and the groove located corresponding to the water way of the nozzle head, the valve having a boss protruding from one end thereof, a tongue extending from the closed end of the path, the valve being rotated when the control member is pivoted so as to open the passage when the inlet communicates with the passage, or to close the passage when the seal member seals the passage, when the inlet communicates with the passage, water passes through the path and flows to the groove via the outlet, and flows through the entrance and the water way of the nozzle head;

wherein the valve includes a second recess defined therein and the second recess is located beside the inlet, the first pivotal portion of the handle has a positioning block protruding inward from an inner periphery thereof, the positioning block is movably received in the second recess when the valve is located in the first pivotal portion to restrict rotational angle of the nozzle head relative to the handle.

2. The watering nozzle as claimed in claim 1, wherein the second pivotal portion has a through hole with which the first pivotal portion is rotatably connected.

3. The watering nozzle as claimed in claim 1, wherein the second pivotal portion of the nozzle head has a protrusion extending axially therefrom, the first pivotal portion of the handle has a first recess in which the protrusion is movable received so as to restrict rotational angle of the nozzle head.

4. The watering nozzle as claimed in claim 1, wherein one of said two seal rings is located between the valve and the first pivotal portion, and another of said two seal rings is located between the pivotal end and the second pivotal portion.

5. The watering nozzle as claimed in claim 1, wherein a second end of the path is an open end and an end plate seals the second end of the path, another end plate has a notch defined in an inside thereof, the tongue of the valve is engaged with the notch, the end plates seal two ends of the valve.

* * * * *